US005186333A

United States Patent [19]

Pierson et al.

[11] Patent Number: 5,186,333

[45] Date of Patent: Feb. 16, 1993

[54] TOP COVER CLAMP FOR SCREENING MACHINE

[75] Inventors: Bruce A. Pierson; William E. Lower, both of Cincinnati, Ohio

[73] Assignee: Rotex, Inc., Cincinnati, Ohio

[21] Appl. No.: 766,789

[22] Filed: Sep. 27, 1991

Related U.S. Application Data

[63] Continuation-in-part of Ser. No. 732,036, Jul. 18, 1991, Pat. No. 5,150,796.

[51] Int. Cl.[5] ..... B07B 1/00

[52] U.S. Cl. ..... 209/370; 209/372; 292/45; 292/201; 292/256; 248/500; 248/638; 198/860.5

[58] Field of Search ..... 209/370, 372; 292/45, 292/201, 256, 256.65, 144; 248/500, 505, 510, 638; 198/735.5, 860.5

[56] References Cited

U.S. PATENT DOCUMENTS

| | | | |
|---|---|---|---|
| 1,874,482 | 8/1932 | Forman | 292/201 |
| 2,079,170 | 5/1937 | Horsley . | |
| 2,370,334 | 2/1945 | Wachter | 292/96 X |
| 2,442,833 | 6/1948 | Watkins | 248/506 X |
| 2,603,739 | 7/1952 | Steen | 292/256 X |
| 2,767,011 | 10/1956 | Buckley | 292/144 X |
| 2,776,854 | 1/1957 | Billstrom | 292/96 X |
| 3,433,357 | 3/1969 | Nolte | 209/372 X |
| 3,481,076 | 12/1969 | Bedard | 292/144 X |
| 3,856,338 | 12/1974 | Johnsson | 292/256.65 X |
| 4,093,176 | 6/1978 | Contastin | 292/256 X |
| 4,230,023 | 10/1980 | Ward | 248/500 X |
| 5,150,796 | 9/1992 | Pierson | 209/370 |

*Primary Examiner*—Joseph E. Valenza
*Assistant Examiner*—Tuan N. Nguyen
*Attorney, Agent, or Firm*—Wood, Herron & Evans

[57] ABSTRACT

Disclosed is a clamp for securing the top cover of a screening machine. Clamping is not subject to galling or seizing and the force exerted is not temperature or displacement dependent. The clamp is air pressure operated, with super-atmospheric pressure being applied for clamping and venting to atmosphere or sub-atmospheric pressure being applied to release the clamp. The clamp is mounted for easy swing away movement when not in use so as to permit the top cover to be removed. Multiple clamps may be simultaneously operated from a common manifold.

10 Claims, 3 Drawing Sheets

TOP COVER CLAMP FOR SCREENING MACHINE

RELATED APPLICATIONS

This application is a continuation-in-part of U.S. patent application Ser. No. 07/732,036, filed Jul. 18, 1991, now U.S. Pat. No. 5,150,796.

This invention relates to screening machines, and more particularly to means for clamping and securing a top cover to the screen box of a screening machine.

BACKGROUND

Commercial screening machines generally have a removable top cover which extends over and closes the top of the screen box in which the screen assembly is mounted. The removable top cover may be completely detachable from the screen box, or hinged to it along an edge. The particulate material to be screened is fed through the cover by an inlet chute which discharges it onto the top screen of the screen assembly. The cover encloses the particulate material being screened, preventing it from being shaken off the screen, minimizing dust, and preventing the entry of dirt and extraneous material. A gasket is often used between the cover and box to provide a better seal. From time to time it is necessary to open the cover, for instance to change or replace a screen or the entire screen assembly. Because the screen box is shaken with substantial force in operation, the cover is typically clamped to the box for movement with it.

Various forms of cover hold-down clamps have been proposed specifically for use on screening machines, including manually operated over-center hold-down clamps, for example of the type shown in Nolte U.S. Pat. No. 3,433,357. In the use of such clamps, a clamping member, adjustable by a screw, is manually engaged with the edge of the cover or frame and an arm is pulled from one side of a center position to the other side, so as to draw together the two members to be clamped. Such manual clamps provide a strong but inflexible clamping force. However, the adjusting screws of such clamps over time can become clogged with dust from the material being screened so that the screws cannot be easily turned to adjust the clamps. An additional problem that may be exhibited by screw type clamps is the tendency of the screw threads to "gall" or seize with extended use, also making it harder to turn the screws and adjust the clamps. With a screw type clamp, the clamping force applied increases as the screw is turned (i.e., with each degree of rotation of the screw). As the clamping force increases, the normal force and therefore the frictional force between thread surfaces also increases, making it harder to turn the screws and adjust the clamps. This problem can be exacerbated when the clamps, after being set up, are subjected to substantial heat in use, as for example when a hot material is being screened. Thermal expansion of the top cover-screen box assembly resulting from such heating subjects the threads to increased force, making it still more difficult to open the clamp. In some circumstances the force of thermal expansion on a tightly set up clamp can even warp or deform the clamp itself.

Spring type clamps have also been used to hold top covers on screen boxes. In such clamps, the clamping force is applied by a compression spring. Even though each applies clamping force differently, screw and spring type clamps can exhibit similar problems when used with a screening machine. For example, relaxation or setting of a gasket can lead to a number of problems shared by both screw and spring clamps.

Several screw or spring clamps are usually needed to hold down a top cover. In order to provide an approximately uniform clamping force at the several clamps around the periphery of the cover (so that the cover is not held too tightly at one area and too loosely at another), each clamp must be manually set or adjusted to provide roughly the same mechanical clamping force. In a large screening machine there may be a dozen or more clamps around the screen box. When several such clamps must all be set and adjusted for uniform force, it often happens that the force of the clamps first set changes by reason of subsequent gasket compression (i.e., flattening) as the other clamps are set so that it is thereafter necessary to go back and readjust the clamps which were first set. Such individual and repetitive adjustment requires substantial time, being done largely by trial and error.

Another problem arises during operation of the screening machine. With time, the gasket clamped between the cover and box can lose its resiliency (i.e., take a set) and therefore become thinner than its as clamped thickness. In fact, it can eventually wear away. Thus, as the gasket becomes thinner with continued operation of the machine, the clamping surface effectively moves away from the clamp. Once set, the clamping force exerted by a screw clamp or spring clamp decreases (as will be shown later, significantly) as the clamping surface moves away (i.e., as the gasket flattens and/or wears away). This problem can also be exacerbated when hot materials are screened. The heat generated during such processing can soften the gasket and speed up the reduction in gasket thickness.

Spring clamps can exhibit an additional problem as a result of hot material screening. The clamping force of a spring tends to drop, if it is exposed to high temperatures.

THE PRIOR ART

Billstrom U.S. Pat. No. 2,776,854 teaches a hydraulic cylinder which when pressurized applies a clamping force to hold a flange against an adjacent surface. The application of pressure to the cylinder also swings a latch into clamping position.

Contastin U.S. Pat. No. 4,093,176 shows an air pressure operated clamp in which application of pressure into a bellows moves a swingable latch member into position to engage beneath a member to be clamped. Upon release of air pressure the clamp is swung to open position by a compression spring. The position at which this occurs is not easily changed, being determined by the fixed geometry and the spring strength.

SUMMARY OF THE INVENTION

In accordance with this invention, a resilient, non-screw clamp is provided. The clamping force is provided by an air pressure operated actuator or "air cushion." The actuator is expanded from its normal (i.e., atmospheric pressure) configuration by internal pressurization; when the pressure is reduced or vented the actuator elastically returns to its normal configuration. The actuator is supported and positioned by at least one, and is preferably straddled by two, clamp arms which are pivotally mounted to one of the members to be clamped, such as the screen box. The actuator is mounted to an outer end of each clamp arm, and the other end of each clamp arm is pivotally mounted to the one member. Several such clamps are provided around the screening machine. The actuators can either be connected to a common source of pressure for simultaneous pressurization or pressurized individually, or a combination of both. Each clamp arm can be manually swung from a release position, in which the clamp does not impede removal of the top cover, to a clamping position, in which the actuator is positioned proximate to the clamping surface, in preparation for clamping. When pressurized, each actuator expands in length, that is, along the line of its central axis. In clamping position, the central axis is aligned with the corresponding clamping surface and pressurization of the actuator expands the actuator axially against the clamping surface, thereby clamping the two members together. Reduction of the air pressure, to atmospheric or sub-atmospheric pressure, disengages (i.e., backs away) the actuator from the clamping surface, allowing the clamp arm to be pivoted away from the clamping surface to the release position and enabling the top cover to be lifted or swung from the screen box without obstruction.

In one embodiment of the present invention, two or more actuators are connected or ganged together for simultaneous swinging movement, by mounting each actuator to a common cross bar which parallels the edge of the top cover. The cross bar is mounted to clamp arms which pivot about the screen box. The actuators can thereby be simultaneously swung into position for clamping the top cover to the screen box. If pressure is applied through a manifold from a common source, all the actuators can be uniformly pressurized, and a uniform clamping force thereby provided around the cover, without having to operate or adjust each clamp individually. When it is necessary to open the machine, pressure is released and/or a vacuum is drawn on all the actuators, to contract them. After the clamping force is released, all the actuators so connected can be simultaneously swung away from their respective clamping surfaces, enabling the cover to be lifted. Thus, this embodiment eliminates the need for manually swinging each actuator in and out of clamping position.

DESCRIPTION OF THE DRAWINGS

The invention can best be further described by reference to the accompanying drawings, in which.

DETAILED DESCRIPTION

Figure 1:
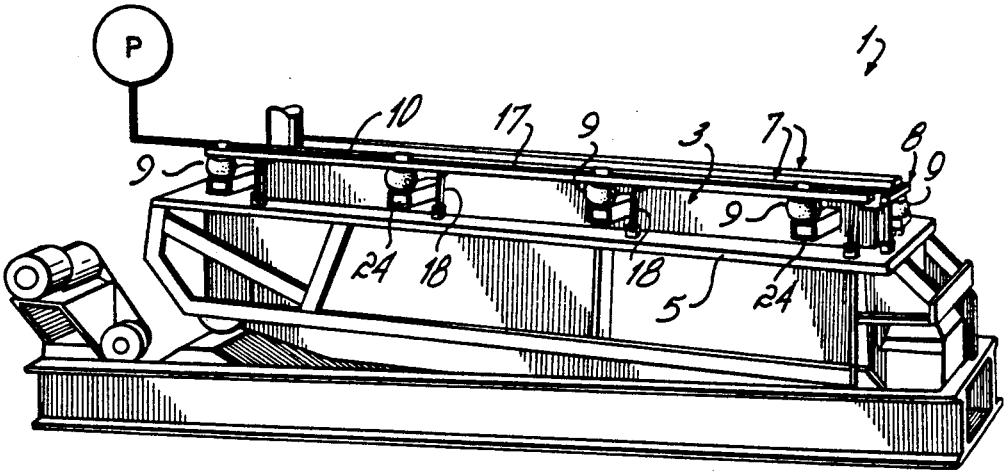
FIG. 1 is a perspective view of one type of screening machine having a pressure operated hold down clamping system in accordance with a preferred embodiment of the present invention.

The clamp of this invention is particularly designed for use on a screening machine 1, shown in FIG. 1. The screening machine includes a removable top cover 3 which is clamped onto a screen assembly 4. The screen assembly 4 comprises one or more screens 4*a* and is seated within a screen box or box frame 5. A frictional gasket 6 is used between the cover 3 and the screen assembly 4 as a seal. Machines of this general type are sold commercially, one example being the "Rotex" screeners made and sold by the assignee of this application. For purposes of illustration, the machine 1 is shown with two embodiments of the present invention. Air actuated clamp assemblies 7 are mounted along the two opposite sides of the screen box 5, and a single clamp 8 is mounted on each end of box 5. Each clamp assembly 7 and the two end clamps 8 are engagable with top cover 3 for clamping it to the screen box 5. (It will be appreciated that alternatively each clamp assembly and clamp could be mounted to the top cover for releasable engagement with the screen box.)

Figure 2:
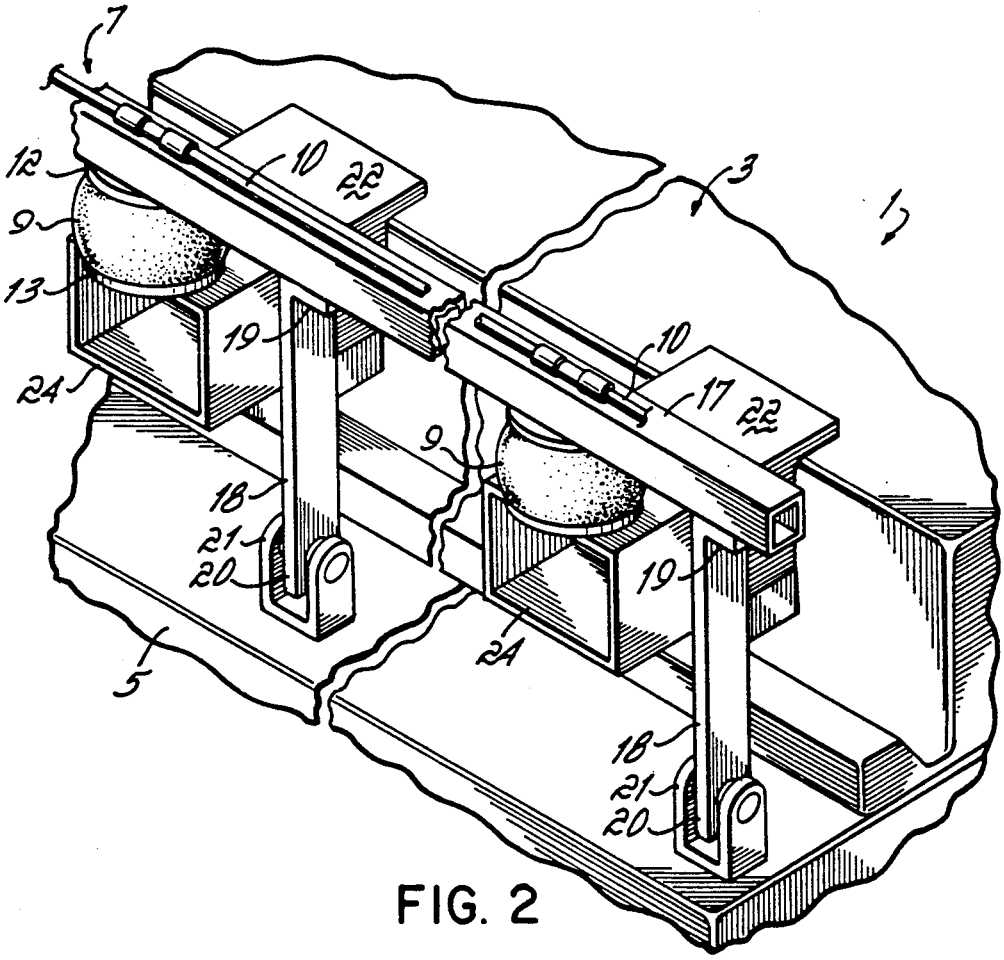
FIG. 2 is an enlarged perspective view, partly broken away, of one of the clamp assemblies of FIG. 1 in clamping position.
Figure 4:
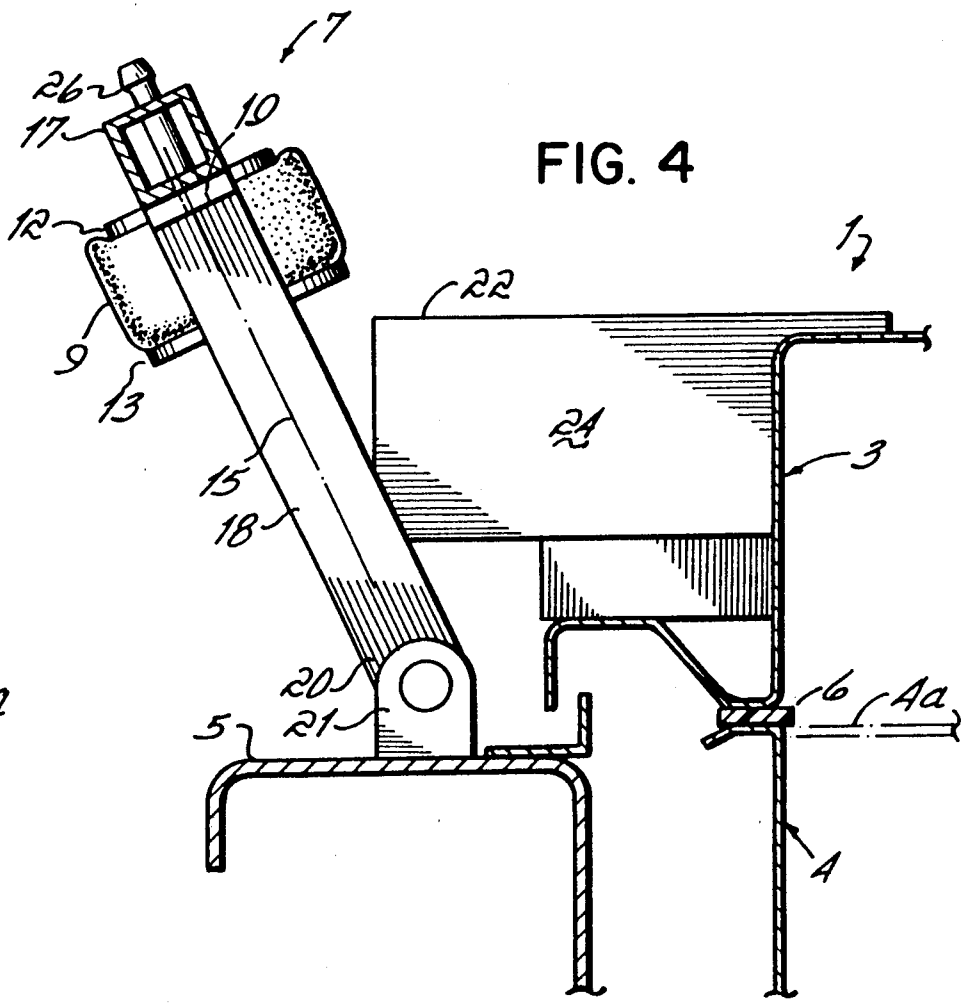
FIG. 4 is a side elevation similar to FIG. 3 but shows an actuator having a separate air inlet for individual pressurization, the clamp assembly being in a disengaged position.
Figure 3:
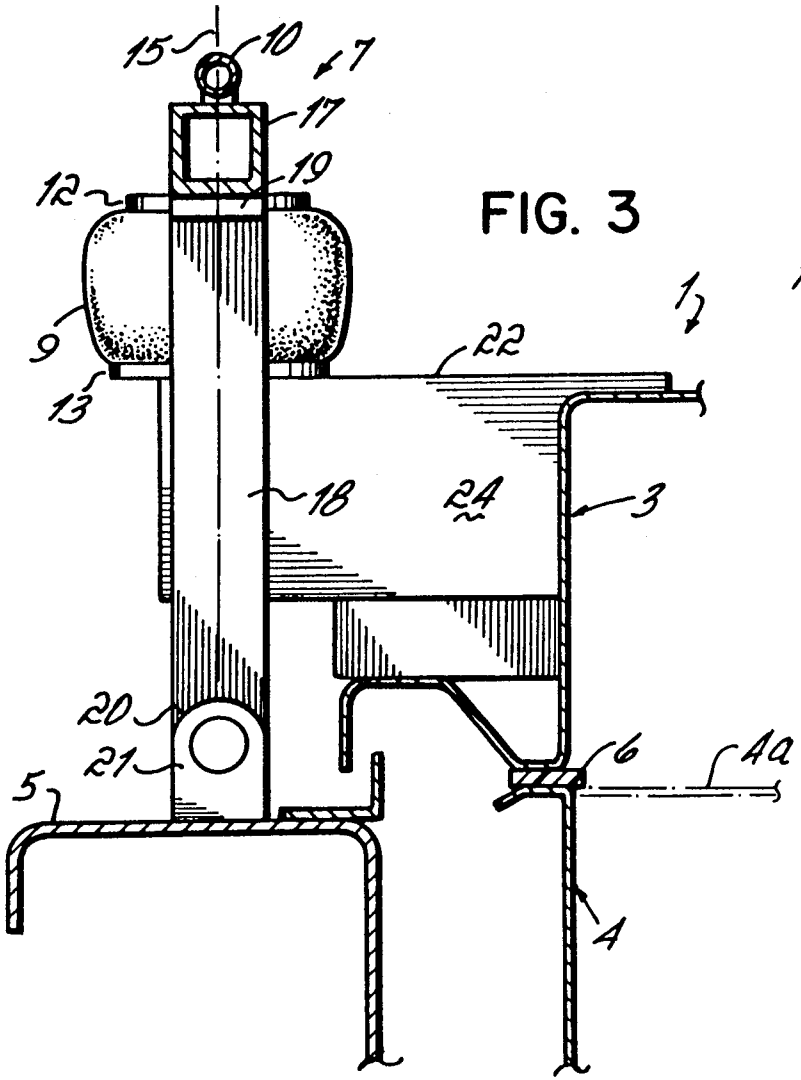
FIG. 3 a side elevation, partly in section, showing the clamp assembly of FIG. 2 in clamping position.

The clamp assembly 7, shown in FIGS. 2–4, comprises one or more expandable or bellows-like air actuators 9 made of air tight flexible material and having an internal pressurizable chamber into which air can be supplied or withdrawn through a conduit or inlet line 10. Each actuator 9 has a first and second end 12 and 13 respectively, and each is preferably symmetrical about its central axis 15. Air line 10 preferably enters the actuator through first end 12, on the axis 15. Admission of pressure to the actuator expands it axially (FIG. 3); release of air contracts it (FIG. 4). Such actuators are commercially available, a preferred type being Firestone model number 1M1A. The first or mounted end 12 of each air actuator 9 is mounted to a cross bar 17, while the second or clamping end 13 is free to engage with the top cover to clamp it. Two or more clamp or swing arms 18 pivotally connect the cross bar 17 to the screen box 5, with the cross bar 17 secured to the outer end 19 of each clamp arm 18 and the pivot end 20 of each clamp arm 18 being pivotally mounted to the screen box 5 by a clevis mount 21. Thus, each actuator 9 can be positioned for clamping by being swung, in a vertical plane, above the clamping surface 22 of a bracket or shelf 24 mounted on the top cover 3.

The conduit line 10 is secured to the cross bar 17 and can be selectively connected to a source of pneumatic super-atmospheric pressure or either vented to atmosphere or connected to a source of sub-atmospheric pressure, the source of super-atmospheric pressure being designated as "P" in FIG. 1. The actuators 9 are in their normal (unexpanded) configuration when they are at atmospheric pressure (i.e. when line 10 is vented). When in their normal configuration and in position for clamping, each clamping end 13 is positioned just slightly above, for example ¼–½ above, and parallel to the clamping surface 22. When air pressure is applied through line 10 the actuator 9 inflates and expands, forcing clamping end 13 away from mounted end 12 and against clamping surface 22, thereby clamping top cover 3 to screen box 5. Operating pressure for clamping may, for example, be in the range of about 20 to 100 PSI, depending on the size of the machine, desired clamping force and other factors. An operating pressure of about 80–90 psi works well for large Rotex machines. The Firestone brand 1M1A actuator referred to above is about 2" high in an unpressurized (i.e., normal) condition; when fully expanded and under no load, it has a height of about 3¼". [In use it exerts a force of 500–600 pounds when pressurized to 85 PSI.]

Venting line 10 to atmosphere (or connecting it to a source of sub-atmospheric pressure) causes the actuator 9 to contract in the axial direction, moving the clamping end 13 closer to the mounted end 12 and away from clamping surface 22. When the clamping pressure is released, the actuators 9 contract and can be pivoted away from the bracket 24 so that cover 3 is free to be removed. Clamps 8 are structured and function similarly. As an alternative to a common line 10, the actuators can be pressurized individually, by using for example a tire-type valve 26 (see FIG. 4).

Use of an air actuated clamp, of the type herein disclosed, has distinct advantages over mechanical type clamps such as screw and spring clamps. With pneumatic line 10 connected to preferably all the actuators 9 (FIG. 1), once the clamping ends 13 are swung into clamping position (FIG. 3), the application of pneumatic pressure in line 10 clamps all the actuators simultaneously, at the same pressure, ensures that the clamping force is uniform around the cover, and eliminates the need to adjust each clamp individually. Clamping force can be adjusted incrementally by changing the applied air pressure.

Figure 5:
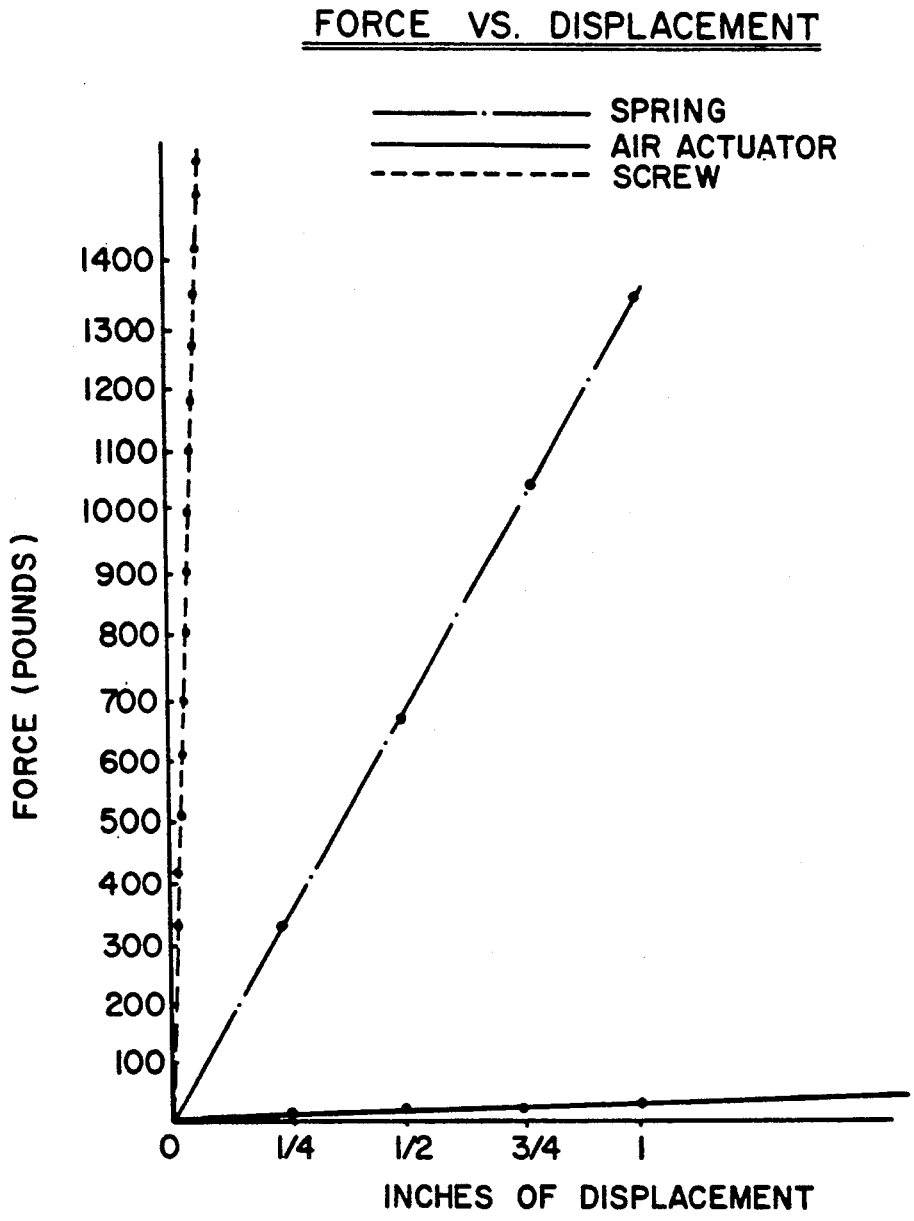
FIG. 5 is a chart comparing the variation of clamping force with displacement for spring, air actuator and screw type clamps.

FIG. 5 compares force versus displacement data, supplied by the manufacturer (Firestone) for an air actuator clamp, with calculated data for a spring clamp and a screw clamp. As can be readily seen from this comparative data, the clamping force of an air actuated clamp is far less sensitive to displacement (i.e., compression) of the actuator than is a spring or a screw clamp. As a result, flattening of a gasket between the top cover and screen assembly, as the gasket takes a set under compression, affects the actual clamping force of an air actuator very little. For example, a decrease in displacement of ⅛" results in the clamping force of an air actuator staying within 10 lbs. of the original value, while such a reduction in displacement would decrease the force exerted by a spring clamp by nearly 200 lbs. and would effectively eliminate the clamping force of a screw type clamp. Similarly, if each clamp type were compressed an additional ⅛" (for example due to thermal expansion of the top cover and screen box), the air actuator clamp would still be the least effected (i.e., the clamping force would increase less than 10 lbs.). Thus, this insensitivity to displacement provides better control over the clamping force applied with an air actuated clamp than with either of the other clamp types.

Moreover, unlike clamps which use screws or threaded rods, the air actuator does not gall or seize, even at high pressure, because it does not use threads to generate the clamping force. Because air pressure provides the clamping force rather than a screw or spring force, the present invention is not adversely affected by the compression forces (i.e., thermal expansion) generated when hot materials are processed. While an increase in temperature does cause gas pressure in a fixed volume to increase, the actuator can expand or, if desired, a pressure release valve can be used to vent excess pressure and insure that the clamping pressure remains uniform.

Even though the present invention requires that the actuators 9 be swung manually into clamping position (FIG. 3) as opposed to the automatic positioning provided by the invention disclosed in parent application Ser. No. 07/732,036, the present invention is much simpler in structure, thus easier and less expensive to construct, than the invention disclosed in the parent application. In addition, the cross bar 17 provides structural support for the conduit line 10.

Having described the invention, what is claimed is:

1. A screening machine having a screen box mounting a screen assembly, a removable top cover on said box, and a plurality of clamps for clamping said cover and said box together, each said clamp comprising:

an inflatable air actuator having opposite first and second ends and being expandable from an unpressurized normal condition by internal pressurization; and at least one clamp arm having a pivot end and an outer end, said pivot end being pivotally mounted to one of said cover and said box, said first end of said actuator being mounted to the outer end of said clamp arm, said cover and said box being clamped together by pivoting said clamp arm to position said actuator proximate to a clamping surface provided by the other of said cover and said box, and pressurizing said actuator to bring said second end to bear against said clamping surface.

2. The machine of claim 1 wherein each said actuator is connected to a common conduit means for supplying each with pressurized air, whereby all said actuators are operated simultaneously by said supply means.

3. The machine of claim 1 wherein each said actuator is pressurized individually.

4. The machine of claim 1 wherein clamp arms are located on opposite sides of said actuator.

5. The machine of claim 4 wherein the first end of said actuator and the outer end of each said clamp arm are connected together by a cross bar.

6. The machine of claim 1 wherein said actuator includes a pneumatic pressure port located on a central axis of said actuator.

7. The machine of claim 1 wherein each pressurized actuator is contracted by sub-atmospheric internal pressure.

8. A screening machine having a screen box mounting a screen assembly, a removable top cover on said box, and a clamping assembly for clamping said cover and said box together, said clamping assembly comprising:

a plurality of inflatable air actuators, each having a first end and a second end, and being expandable from a normal attitude by internal pressurization;

a cross bar mounted to each of said first ends;

a plurality of clamp arms, each having an outer end and a pivot end with each outer end being mounted to said cross bar and each pivot end being pivotally mounted to one of said cover and said box, wherein each said second end can be urged against a clamping surface provided by the other of said cover and said box by pivoting said clamp arms to position said second end proximate to said clamping surface and pressurizing said actuator; and a common supply means connected to said actuators for selectively supplying each with pressurized air, whereby all said actuators are operated simultaneously by said supply means.

9. The machine of claim 8 wherein a conduit line supplies the pressurized air to each actuator and is attached to said cross bar.

10. The machine of claim 8 wherein each pressurized actuator is contracted by sub-atmospheric internal pressure.

* * * * *